United States Patent [19]

Beavers

[11] Patent Number: 4,637,748

[45] Date of Patent: Jan. 20, 1987

[54] HUB AND STRUT-ENDCAP ASSEMBLY FOR TENT FRAME STRUTS

[75] Inventor: Allan E. Beavers, Littleton, Colo.

[73] Assignee: T. A. Pelsue Company, Englewood, Colo.

[21] Appl. No.: 743,983

[22] Filed: Jun. 7, 1985

[51] Int. Cl.[4] ..... F16B 17/00

[52] U.S. Cl. ..... 403/170; 403/172; 403/217; 403/141; 52/82; 135/98; 135/109

[58] Field of Search ..... 135/109, 98, 102, 106, 135/120, DIG. 9; 52/82; 403/170, 217, 218, 219, 171, 172, 178, 141

[56] References Cited

U.S. PATENT DOCUMENTS

| | | | |
|---|---|---|---|
| 3,181,542 | 5/1965 | Bareis | 135/98 |
| 3,818,482 | 5/1974 | Beavers | 403/217 X |
| 3,968,809 | 5/1975 | Beavers | 135/5 |
| 4,026,312 | 5/1977 | Beavers | 135/109 |
| 4,077,417 | 3/1978 | Beavers | 135/120 X |
| 4,285,354 | 8/1981 | Beavers | 135/102 |
| 4,450,851 | 5/1984 | Beavers | 135/DIG. 9 |

FOREIGN PATENT DOCUMENTS

| | | | |
|---|---|---|---|
| 443528 | 4/1927 | Fed. Rep. of Germany | 403/217 |

*Primary Examiner*—Cornelius J. Husar

*Assistant Examiner*—Joseph A. Fischetti

*Attorney, Agent, or Firm*—Edwin L. Spangler, Jr.

[57] ABSTRACT

This invention relates to an improved self-adjusting hub and strut-endcap assembly for tent frame roof and wall struts characterized by a two-part hub section sandwiched together in stacked relation to define a set of four sockets, each of which has a channel-shaped entryway which is adapted to receive the socket-forming neck projecting from the ball on the inner end of one of the strut endcaps for limited side-to-side movement therein when in extended position as well as movement between its extended position and a folded position wherein the strut connected thereto lies in nested essentially parallel relation to the other struts of the frame. The socket entryways in the hub each has their adjacent walls flared such that adjacent pairs of strut-endcaps retained therein can move from an extended right-angular relation to one another into an acute-angular relation thus cooperating with a like pair of sockets on the other side of the hub to enable the struts mounted therein to self-adjust and move from an essentially radial position from which a square wall or roof structure can be formed into non-radial relationship adapted to the formation of four-sided figures with at least two unequal sides.

10 Claims, 4 Drawing Figures

HUB AND STRUT-ENDCAP ASSEMBLY FOR TENT FRAME STRUTS

In my U.S. Pat. No. 4,450,851, I disclose a tent frame hub assembly which, when made up in the form of a polygonal ring containing four or more hingedly interconnected strut end-receiving socket subassemblies, produces a self-adjusting structure that can be used to form multi-sided walls and the like having sides of any desired length including all of them equal. I have now developed an improved hub analogous to the one aforementioned in terms of function and application but differing therefrom in structure, the one forming the subject matter of the instant application being much simpler and less expensive.

In addition to the above, I hold several other U.S. patents on folding tents among which are U.S. Pat. Nos. 3,941,140; 3,968,809; 4,026,312; 4,077,417; and 4,285,354. The aforementioned patents deal for the most part with tent frame wall and roof structures wherein the struts used to connect the hub at the center with the corners are relatively thin and bendable to the extent that even though the strut-receiving endcaps in the hub open out radially when in unfolded or extended position, the struts themselves can bend to the extent necessary to form a rectangular or trapezoidal wall structure. As the tubular plastic struts get bigger, say three-fourths inch outside diameter and larger, their walls become thicker and they will no longer bend to any significant degree, i.e. more than a few inches in a length of several feet. This resulted in having to redesign the hub so as to accommodate both square and irregular four-sided wall and polygonal roof structures. My earlier attempt at solving this problem is exemplified in the previously-mentioned U.S. Pat. No. 4,450,851 which is the closest prior art of which I am presently aware. Its construction, by the way, is somewhat more versatile and still preferred in those applications calling for polygonal roofs having more than four sides.

Since by far the majority of applications in even large tents involved four-sided walls and roofs, generally either square or rectangular, a need arose for a simpler and less expensive version of the hub and strut-endcap assembly which would accommodate these specific uses while, at the same time, allowing the ratio between the wall or roof frame height and length to be varied over a rather wide range, preferably automatically in some self-adjusting fashion. Quite unexpectedly I discovered that if opposite pairs of struts could freely move from a right-angular relationship into an acute-angular relationship of down to only about 70°, I could accommodate a ratio of wall heights to lengths and vice versa that encompassed easily one and one-half to one. Accordingly, by the simple, yet unobvious, expedient of cutting away and thus flaring the adjacent sides of adjacent slots forming the entryways into the sockets in one set of opposite pairs thereof no more than 10° while leaving the adjacent sides perpendicular to one another in the remaining set of opposite pairs of slots at right angles thereto, the sought-after ratio of heights to lengths could be easily taken care of. Moreover, the cooperative relationship between the ball-carrying endcaps and the flared slots was such that the former in unfolded position always seated firmly against one side or the other of the latter regardless of the height to length ratio. In other words if, for example, the selected width to height ratio were, say, one and one-fourth to one, the strut-end-receiving sockets in the endcaps would not occupy an intermediate position out of contact with either side of the slot, but instead, the hub would rotate relative to the strut sockets until it established and maintained firm contact with one or the other of their slot walls. In so doing a slight bend in the strut might have to take place but one well within the capability of such structures to accommodate.

The tent frame hubs in all of my collapsible tent designs allow the struts to move from a folded position in essentially parallel nested relation to an unfolded or extended over-center position maintained by cables connected and stretched between the outer extremeties of the four struts in unfolded position, and the instant hub and strut-endcap assembly follows this same pattern. I now find it more practical and considerably less expensive to provide each strut-endcap with a simple tubular neck having a cylindrical bore into which I fasten the strut with an adhesive rather than using the complex casting of my earlier version in which a tapered plug was employed to squeeze the wall of the strut within an annular groove formed between opposed walls of the endcap neck.

Apart from the bolts holding the hub and strut-endcaps in assembled relation, the hub is comprised of two parts stacked one atop the other to define the sockets and slightly flared slots defining entryways thereto. A centerhole in the hub allows for the skin of the wall or roof to be attached to the frame such that the frame and skin fold or collapse together in the manner of my previous tent designs. All parts are simple castings requiring no machining and assembly of the entire wall or roof frame takes but a matter of minutes.

Accordingly, it is the principal object of the present invention to provide a novel and improved hub and strut-endcap assembly for collapsible tent roof and wall frames.

A second objective of the invention herein disclosed and claimed is to provide an assembly of the type aforementioned which is self-adjusting so as to automatically accommodate a wide range of different wall height to length ratios.

Another object of the within-described invention is that of providing a tent hub and strut-endcap assembly in which the strut-receiving sockets seat at all times against one or the other of the flared slot walls.

Still another objective of the claimed hub assembly is to provide a unit especially well suited to the formation of four-sided square and rectangular subframes for tents walls and the like.

An additional object is to provide a tent frame hub wherein the endcaps each contain a simple blind-ended strut end-receiving neck into which the strut end is inserted and fastened with a suitable adhesive.

Further objects are to provide a hub and strut-endcap assembly for rectangular tent frames which is simple, easy to assemble, inexpensive, rugged, versatile, lightweight and even decorative.

Other objects will be in part apparent and in part pointed out specifically hereinafter in connection with the description of the drawings that follows, and in which.

Figure 1:
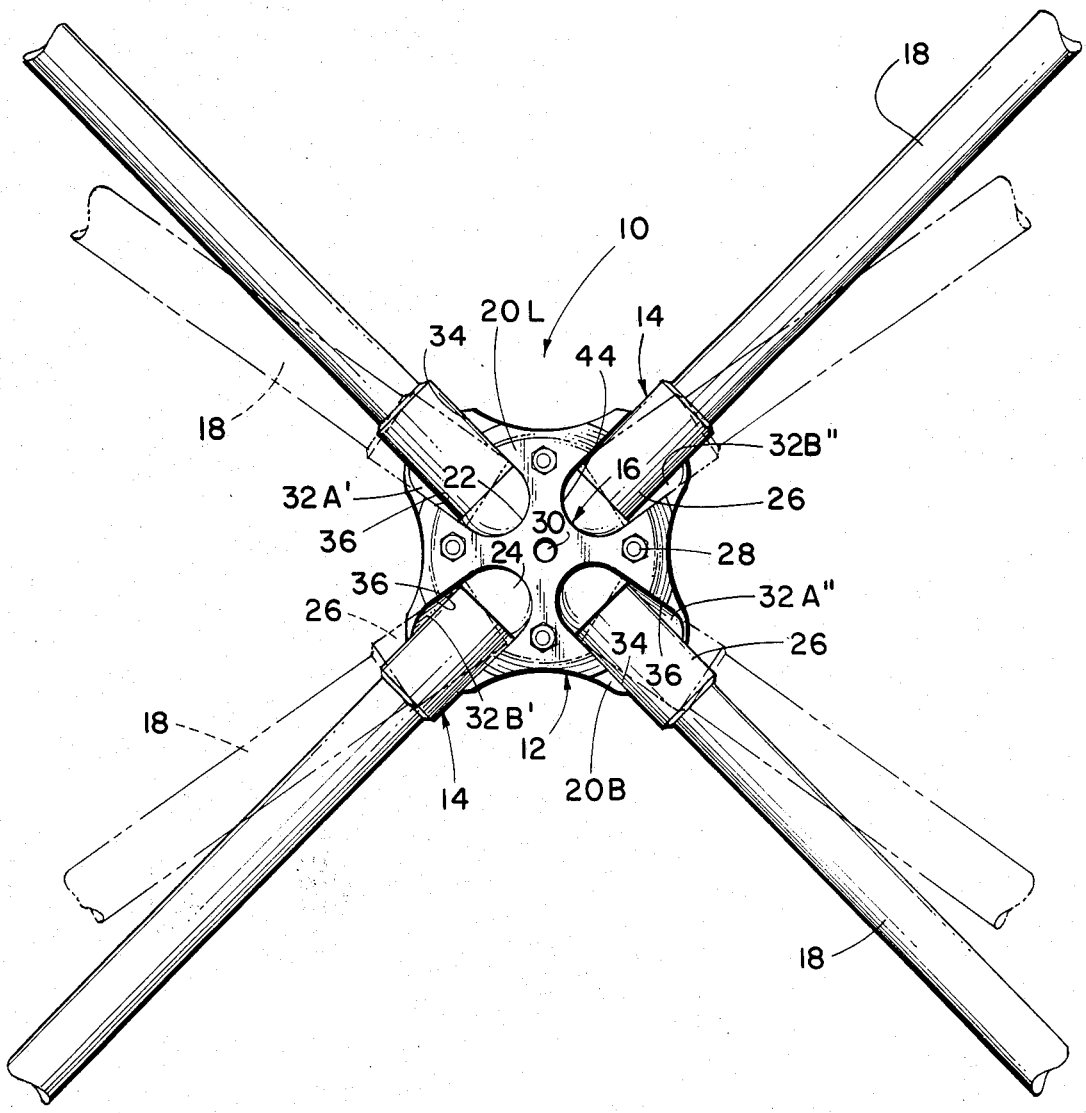
FIG. 1 is a fragmentary top plan view showing in full lines the struts and their endcaps diagonally-aligned in their radially-extending positions in which adjacent pairs thereof are in right-angular relation to one another as well as the phantom line position in which the struts in opposite pairs lie in either non-radial acute or obtuse angular relation.
Figure 2:
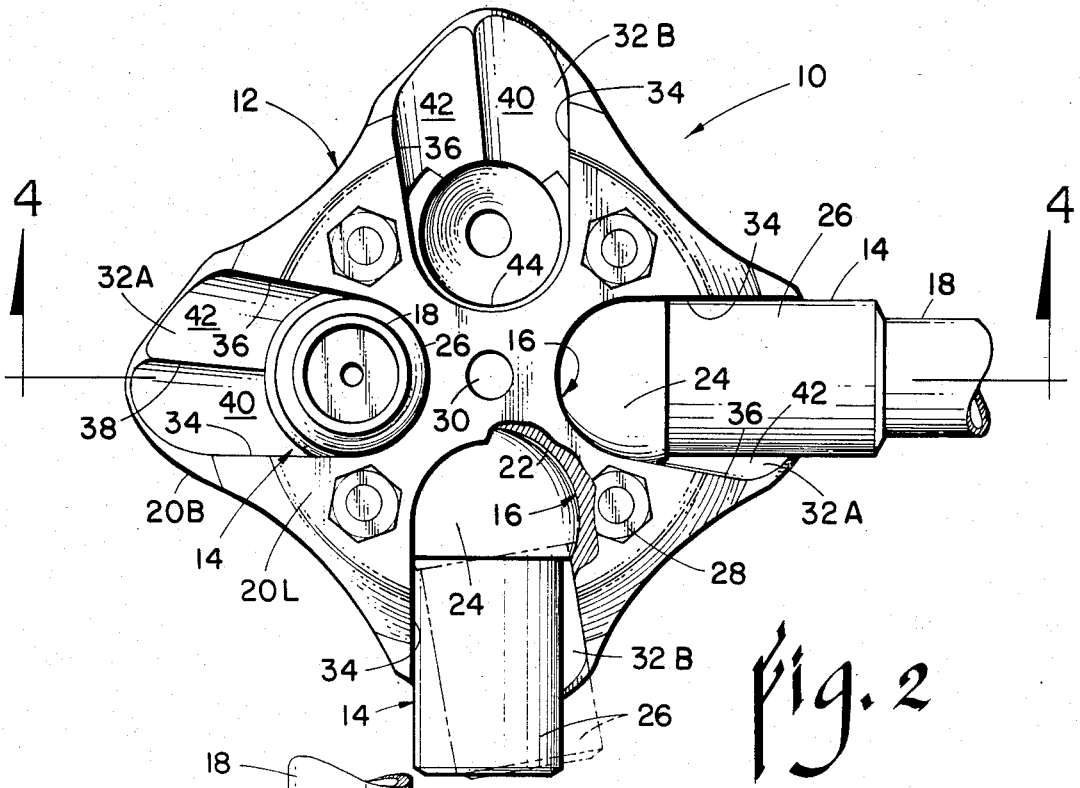
FIG. 2 is a fragmentary top plan view to a greatly enlarged scale, portions of which have been broken away and shown in section, detailing in full and phantom lines the alternative positions of the strut-endcaps and their associated struts.
Figure 3:
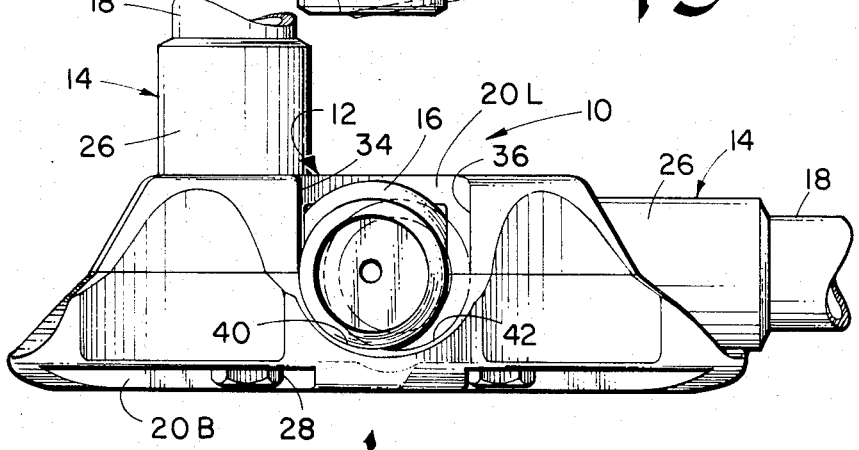
FIG. 3 is a fragmentary side elevation to the same scale as FIG. 3.

Referring next to the drawings for a detailed description of the present invention and, initially, to FIGS. 1 and 2 for this purpose, reference numeral 10 has been selected to designate the hub and strut endcap assembly in a general way while numerals 12 and 14 have been chosen to similarly identify the principal components thereof, specifically, the hub and endcaps, respectively. Four endcaps are needed, all of which are identical. A single hub 12 mounts all four of the endcaps for limited side-to-side movement when in extended or unfolded position as indicated by the full and phantom line representations of FIGS. 1 and 2. The ball-and-socket connection indicated broadly by reference numeral 16 and soon to be described in detail with reference to FIG. 4, also allows the endcaps and the struts 18 associated therewith to be folded into nested essentially parallel relation as seen in FIGS. 2 and 3, this being a common characteristic of all of my tent frame hub and endcap assemblies.

Figure 4:
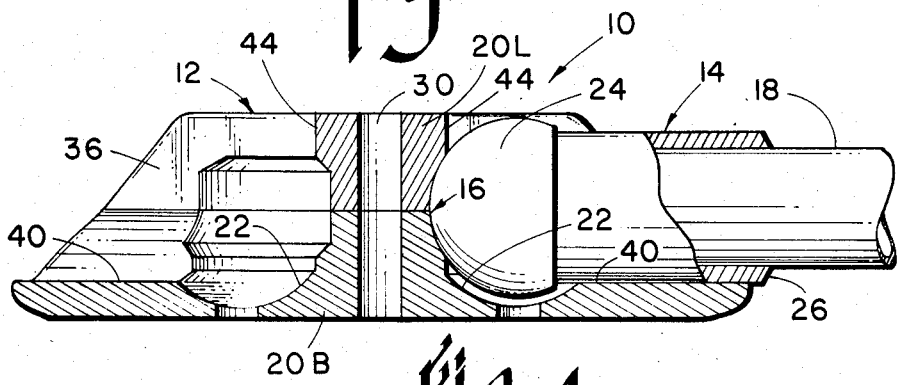
FIG. 4 is a diametrical section taken along line 4—4 of FIG. 2.

Leaving FIG. 1 for the moment and turning to FIGS. 2, 3 and 4, the hub 12 will be seen to comprise a two-part subassembly consisting of a base 20B topped by what will be referred to here as a "lid" element 20L in that when bolted or otherwise fastened down atop the base it cooperates therewith to define sockets 22 which capture and retain the balls 24 on the inner ends of the endcaps for the limited relative universal movement that will be described presently. Balls 24 encompass about three-fourths of a full sphere at which point they are truncated and merged with the tubular neck-forming sleeves 26 that receives the strut end as shown. The struts are joined to the endcaps using a suitable adhesive. In the particular form shown, the base and lid of the hub are detachably fastened together by four bolts 28 which pass through the areas between the sockets. The central opening 30 in the hub has as its function that of passing a cord (not shown) by means of which the skin of the tent can be attached at its center to the frame therefor and thus be caused to fold inside the nested struts when the tent is stowed, all of which is more fully explained in my earlier patents already mentioned.

Now, the key to the instant invention and its novelty lies in the shape of the entryways 32 leading into the ball-receiving sockets 22 of the hub 12 for which purpose particular reference will be made to FIGS. 2 and 3. In FIG. 2 it can be seen that diametrical pairs 32A and 32B are the same shape but pairs A and B are mirror images of one another. Each of the entryways has an abutment-forming sidewall thereof 34 which lies in spaced parallel relation to a radial line emanating from the center of the hub as the latter is defined by the center of central opening 30. The extent of the lateral offset is the radius of the outside diameter of the tubular sleeve 26. Thus, as seen in full lines in FIG. 1, when all four of the strut endcaps are positioned such that their neck-forming sleeves 26 abut up against their respective sidewalls 34, all four of the struts 18 will be extending out radially from the hub and bear a 90° angular relation to one another. It is most significant to note, however, that two abutment-forming walls 34 are positioned to engage the righthand side of the sleeves 26 positioned in each of the entryways 32A comprising the A pair thereof; whereas, the same walls 34 engage the lefthand side of the sleeves 26 in each of the entryways 32B comprising the B pair as seen from the top center of the hub. Nevertheless, if all four struts are the same length, as is usually the case in tent construction, then with the outer or remote ends thereof connected together by a cable in the manner of my earlier wall and roof frames, the resulting panel will be square. Obviously, by varying the length of the struts they can be assembled to form parallelograms, both irregular and regular trapezoids, the latter having some application in tent construction.

Each of the entryways 32 also has a second abutment-forming wall 36 arranged in opposed divergent relation to the first. Divergent walls 36 of the diametrically-arranged A pair of entryways 32A as seen from the top center of the hub (FIGS. 1 and 2) both lie to the left of walls 34; however, in the B pair, the opposite is true and the divergent walls 36 lie to the right of the wall 34 which engages and holds the sleeve 26 of the particular endcap in radially-extending position. This arrangement, of course, places a divergent wall 36 of adjacent entryways of the A pair and B pair next to one another as seen most clearly in FIG. 2. In other words if, as illustrated, entryway 32A′ lies adjacent entryway 32B′ and, similarly, entryway 32A″ lies next to entryway 32B″, then the single-prime entryways 32A′ and 32B′ are mirror images of one another as are the double-prime entryways 32A″ and 32B″. As a matter of fact, it is the latter paired sets of mirror-imaged entryways (single-prime and double-prime) that cooperate to form the abutments (36) used when the strut-endcap sleeves 26 lie thereagainst to define the other than square four-sided wall and roof structures.

In FIGS. 2 and 3, it will be seen that each of the four entryways contains a ridge 38 in the base thereof defined by the intersection of the divergent generally cylindrical seats 40 and 42 which merge into upstanding abutment-forming wall structures 34 and 36, respectfully. Seat 40 is the radially-extending one while the axis of seat 42 is skewed a few degrees to one side or the other of the axis of seat 40. In actual use, the sleeves of the strut-endcaps will rest in one or the other of the seats 40 and 42 abutting their respective abutment-forming walls 34 or 36. This happens because the hub itself is free to rotate clockwise or counterclockwise when the remote ends of the struts are tied together by cables (not shown). Thus, assuming that the abutment-forming wall 36 and its seat 42 diverges at an angle of 10° from its companion wall 34 and seat 40, then, whenever the strut pattern is such that the included angle between a particular strut and the adjacent struts on both sides thereof is less than 100° and over 80°, respectively the strut-endcap sleeves will all likely lie seated in the radially-extending seats 40 abutting walls 34. Conversely if, on the other hand, the strut pattern is one in which they are tied together at their remote ends when in extended or unfolded position wherein the included angle between a particular strut and the adjacent struts on both sides thereof is more than 100° and less than 80°, respectively then the reverse is likely to take place and the hub will automatically rotate into a position in which the strut-endcap sleeves all lie in seats 42 resting up against flared wall 36. The significance in all this is, of course, that regardless of the angulation of the struts relative to one another in the frame within the preset limits that accommodate some bending, say 10° or so, the strut-endcap sleeves in which they are seated will occupy one seated position or the other and never occupy an unstable intermediate position therebetween. Moreover, as previously noted, while a 10° flair will mathematically accommodate a height to length ratio approaching 1.5:1, the struts are not rigid and can easily bend a few degrees one way or another over their length of several feet; therefore, as a practical matter I have found that a 10° divergence between abutment-forming walls 34 and 36 is entirely adequate for all but the most extreme situations. This provides a strut angle divergence totalling 20° without bending and probably at least 30° with it.

Seats 44 in the lid-forming section 24 of the hub receive the sleeves 26 of the strut-endcaps when they, together with their struts, are in the folded or nested position (see the lefthand strut-endcap/strut subassembly of FIGS. 2 and 3). While it is not critical, these seats have been shown with their axes paralleling the axis of central opening 30.

What is claimed is:

1. The self-adjusting hub and strut-endcap assembly for tent frame roof and wall struts which comprises: a hub two piece member shaped and joined together to provide four ball-receiving sockets arranged in equiangularly-spaced relation around the center thereof with each such socket adapted to receive and retain a ball for universal movement therein, and said hub member including side-opening channel-forming entryways leading into each socket, said entryways each having divergent sidewalls bordering a pair of intersecting seats at the base thereof bearing an acute angular relation to one another, one of said pair of seats extending radially outward from its ball-receiving socket while the other of said paired seats is skewed with respect to said radially-extending one, and diametrically-located pairs of said entryways having their skewed seats opposite one another; and, four strut-endcap elements each having a ball on the inner end thereof and a tubular sleeve projecting outwardly from said ball for receiving the inner end of a tent frame strut, said ball when seated in a ball-receiving socket in the hub being shaped and adapted to align the sleeve depending therefrom for limited side-to-side movement between a first position seated in the radially-extending seat of the flared entryway and a second position seated in the skewed seat thereof, said hub member and strut-endcap elements cooperating with one another in assembled relation with the sleeves seated in their first positions to define an assembly specifically adapted to the formation of a square wall or roof frame, and said member and elements cooperating with said sleeves seated in their second positions to define a four-sided polygonal frame having at least two unequal sides.

2. The hub and strut-endcap assembly as set forth in claim 1 wherein: the paired seats are cylindrically concave and intersect to define a ridge therebetween effective to cam the sleeve engaging same into one of its alternative positions when the remote strut ends are interconnected in frame-forming relation.

3. The hub and strut-endcap assembly as set forth in claim 1 wherein: the sidewalls of the entryways define fixed abutments effective to limit the side-to-side movement of the endcap sleeves.

4. The hub and strut-endcap assembly as set forth in claim 1 wherein: the hub member comprises a base and a lid-forming element cooperating with one another when fastened together in stacked relation to define the ball-receiving sockets and flared entryways.

5. The hub and strut-endcap assembly as set forth in claim 1 wherein: the hub member includes a third set of seats on the opposite side of the sockets from the paired seats of the entryway, said third set of seats being positioned and adapted to abut the endcap sleeves and maintain them in an upright position with the axes thereof essentially parallel to one another.

6. The hub and strut-endcap assembly as set forth in claim 1 wherein: the hub member includes a central opening therethrough for fastening means attaching the latter to the tent frame skin.

7. The hub and strut-endcap assembly as set forth in claim 2 wherein: the paired seats of the entryways intersect at an angle no greater than approximately 15°.

8. The hub and strut-endcap assembly as set forth in claim 3 wherein: the sidewalls of the entryway diverge at an angle no greater than approximately 15°.

9. The hub and strut-endcap assembly as set forth in claim 7 wherein: the paired seats of the entryways intersect at an angle of approximately 10°.

10. The hub and strut-endcap assembly as set forth in claim 8 wherein: one sidewall of each entryway lies in parallel relation to a radial line extending from the center of the hub member spaced to one side thereof a distance equal to the outside radius of the sleeve.

* * * * *